US006279997B1

(12) United States Patent
Moore et al.

(10) Patent No.: US 6,279,997 B1
(45) Date of Patent: Aug. 28, 2001

(54) PORTABLE PEW

(75) Inventors: Lorraine Moore, Cameron; Barry E. Pratt, Belton, both of TX (US)

(73) Assignee: Trinity Furniture Manufacturing Company, Cameron, TX (US)

( * ) Notice: Subject to any disclaimer, the term of this patent is extended or adjusted under 35 U.S.C. 154(b) by 0 days.

(21) Appl. No.: 09/470,477

(22) Filed: Dec. 22, 1999

(51) Int. Cl.[7] ..... A47C 7/00

(52) U.S. Cl. ..... 297/440.1; 297/440.13; 297/440.14; 297/440.15

(58) Field of Search ..... 297/440.1, 440.14, 297/440.13, 440.15

(56) References Cited

U.S. PATENT DOCUMENTS

| | | | | |
|---|---|---|---|---|
| 3,987,534 | * | 10/1976 | Gold | 297/440.15 X |
| 4,062,589 | * | 12/1977 | Klein et al. | 297/440.15 X |
| 4,576,353 | * | 3/1986 | Valeria | 297/440.13 X |
| 4,602,817 | * | 7/1986 | Raftery | 297/440.1 |
| 4,828,324 | * | 5/1989 | Putnam | 297/440.1 |
| 4,848,839 | * | 7/1989 | Galardo | 297/440.1 |
| 4,919,485 | * | 4/1990 | Guichon | 297/440.15 X |
| 5,069,506 | * | 12/1991 | Wieland | 297/440.1 X |
| 5,244,271 | * | 9/1993 | Hackwood et al. | 297/440.15 X |
| 5,277,476 | * | 1/1994 | Caldwell | 297/440.13 X |
| 5,415,454 | * | 5/1995 | Fu-Tsang | 297/440.1 X |
| 5,470,128 | * | 11/1995 | Kerkham | 297/440.14 X |
| 5,522,182 | * | 6/1996 | Rogers | 297/440.14 X |
| 5,887,950 | * | 3/1999 | Kuo | 297/440.13 |

FOREIGN PATENT DOCUMENTS

| | | | | |
|---|---|---|---|---|
| 1291159 A | * | 3/1962 | (FR) | 297/440.14 |

* cited by examiner

*Primary Examiner*—Peter M. Cuomo
*Assistant Examiner*—Rodney B. White
(74) *Attorney, Agent, or Firm*—Wendy K. Buskop; Buskop Law Group, PC

(57) ABSTRACT

A portable pew, that comprises (1) a first, second, third, and fourth cam attached to a seat portion; (2) the seat portion, having a seat bottom, a seat top, a first seat side, a second seat side, a third seat side, and a fourth seat side, and wherein the first cam is pivotally attached to the first seat side and the second cam is pivotally attached to the second seat side; and the third cam is pivotally attached to the seat bottom, and the fourth cam is pivotally attached to the third seat side; (3) at least one back portion having a back portion front, and a back portion back, a first back side, a second back side, a third back side and a fourth back side, and wherein the first cam is additionally pivotally attached to the first back side.

4 Claims, 3 Drawing Sheets

PORTABLE PEW

BACKGROUND OF THE INVENTION

In this day and age of increased costs, the need for additional space at the lowest cost possible is a prime objective of most planners, architects and others interested in building utilization. One of the most efficient ways to gain additional space at minimal cost is to encourage and specify multiple use of buildings.

Nowhere has this need for adequately designed, multiple use building facilities been more encouraged or needed than in church, synagogue or auditorium construction.

It should also be noted that many churchmen are striving for ways to generate renewed interest in church activities, not the least of which is increased attendance. Once way which has proven effective is the ability to be flexible in the interior arrangement of the church to get away from the rigid and formal church interior to something more informal for the younger people while still permitting rearrangement in the more traditional way for the older church members.

Until the advent of the present invention, there have been only a few means available to design and construct a church or synagogue in which customary pews were available during the services, but which could also be conveniently moved to create a more flexible interior or stored away completely in an out of the way location so that the interior space of the building could be used for other purposes. Until now, the best available space was the use of folding chairs or movable benches. None of these available devices add to the interior design or give the effect that is achieved in a church building by the addition of traditional pews. The present day devices all have the disadvantage of requiring large numbers of people to assist in setting up and breaking down the seats.

According to the present invention, it is now possible to offer a better alternative to achieve a traditional interior design of a house of worship when the building is to be so used, yet, at the same time, provide the flexibility to be easily moved and stored away to permit the same interior space to be used for other functions.

It is, therefore, the primary object of this invention to provide a flexible alternative to interior church design which will permit maximum utilization of available space and thereby save building costs.

It is a further object of the present invention to provide a portable pew which provides traditional pew construction and appearance, while at the same time providing an easily storable compact unit, easy to ship.

A still further object is to provide a simple construction for the portable pew which can easily be folded up and moved and then replaced again.

These and other objects of the invention will become more apparent from the detailed description of the pew to follow.

SUMMARY OF THE INVENTION

A collapsible, and extendable pew, comprising a first camming means, a second camming means; a third camming means and a fourth camming means attached to the pew; having at least one seat, the seat having a seat bottom, a seat top, a first seat side, a second seat side, a third seat side, and a fourth seat side, and wherein said first camming means is pivotally attached to the first seat side and the second camming means is pivotally attached to the second seat side; and the third camming means is pivotally attached to the seat bottom, and the fourth camming means is pivotally attached to the third seat side; at least one back portion having a back portion front, and a back portion back, a first back side, a second back side, a third back side and a fourth back side, and wherein the first camming means is additionally pivotally attached to the first back side; at least one folding leg portion for supporting the portable pew in the position for use which is secured to the seat bottom with the third camming means.

DESCRIPTION OF PREFERRED EMBODIMENT

Figure 1:
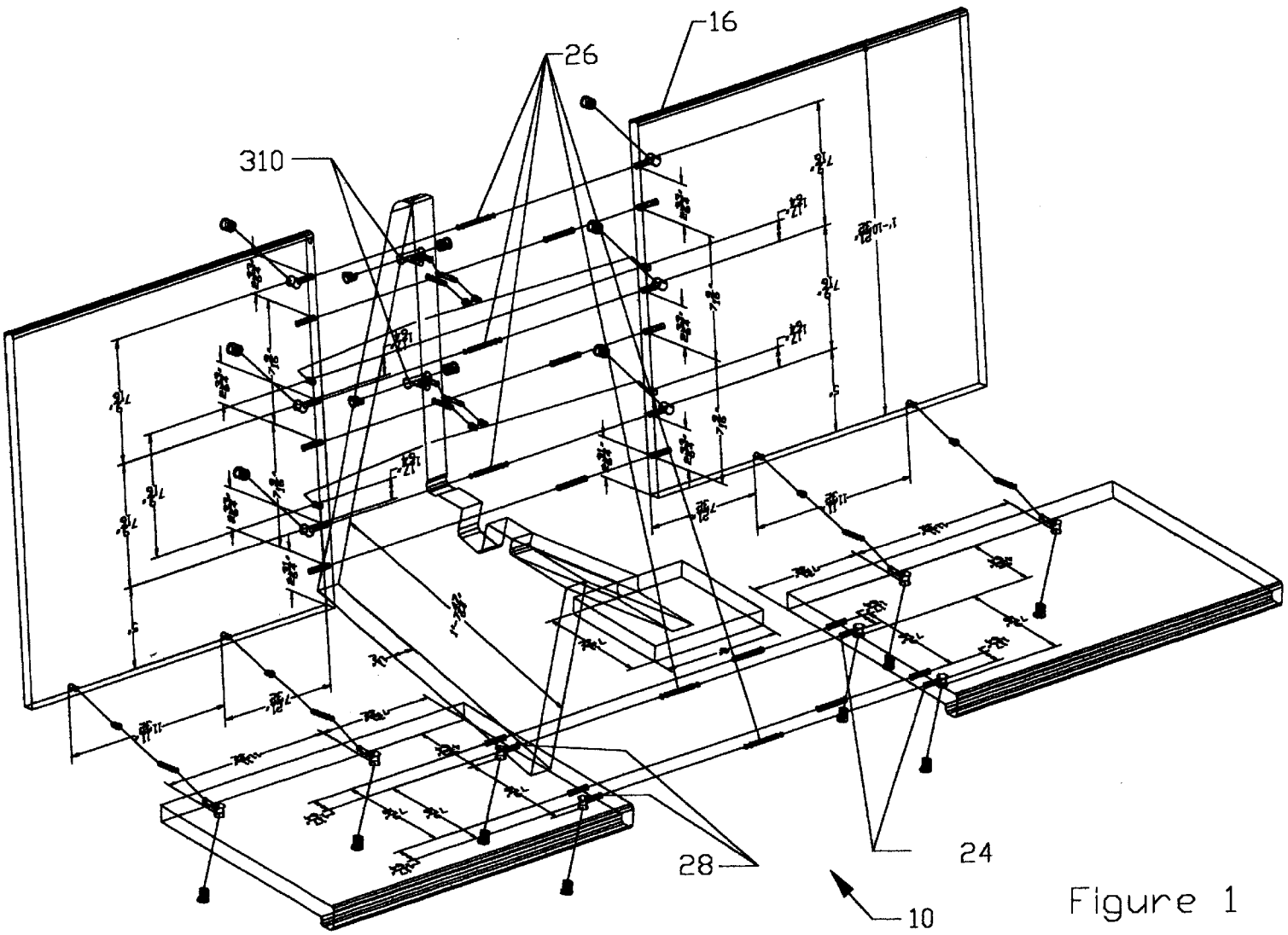
FIG. 1 is a prospective view of the pew described by the present invention.

In FIG. 1 portable pew 10, utilizes a unique locking and engaging system which acts as a camming means to provide simultaneous positive locking and positive unlocking ability. In this embodiment the portable pew can be comprised of alternatively one seat or a series of seats engaged together to form an extremely long portable pew.

The portable pew 10 has first camming means 24, second camming means 26, third camming means 28.

Figure 2:
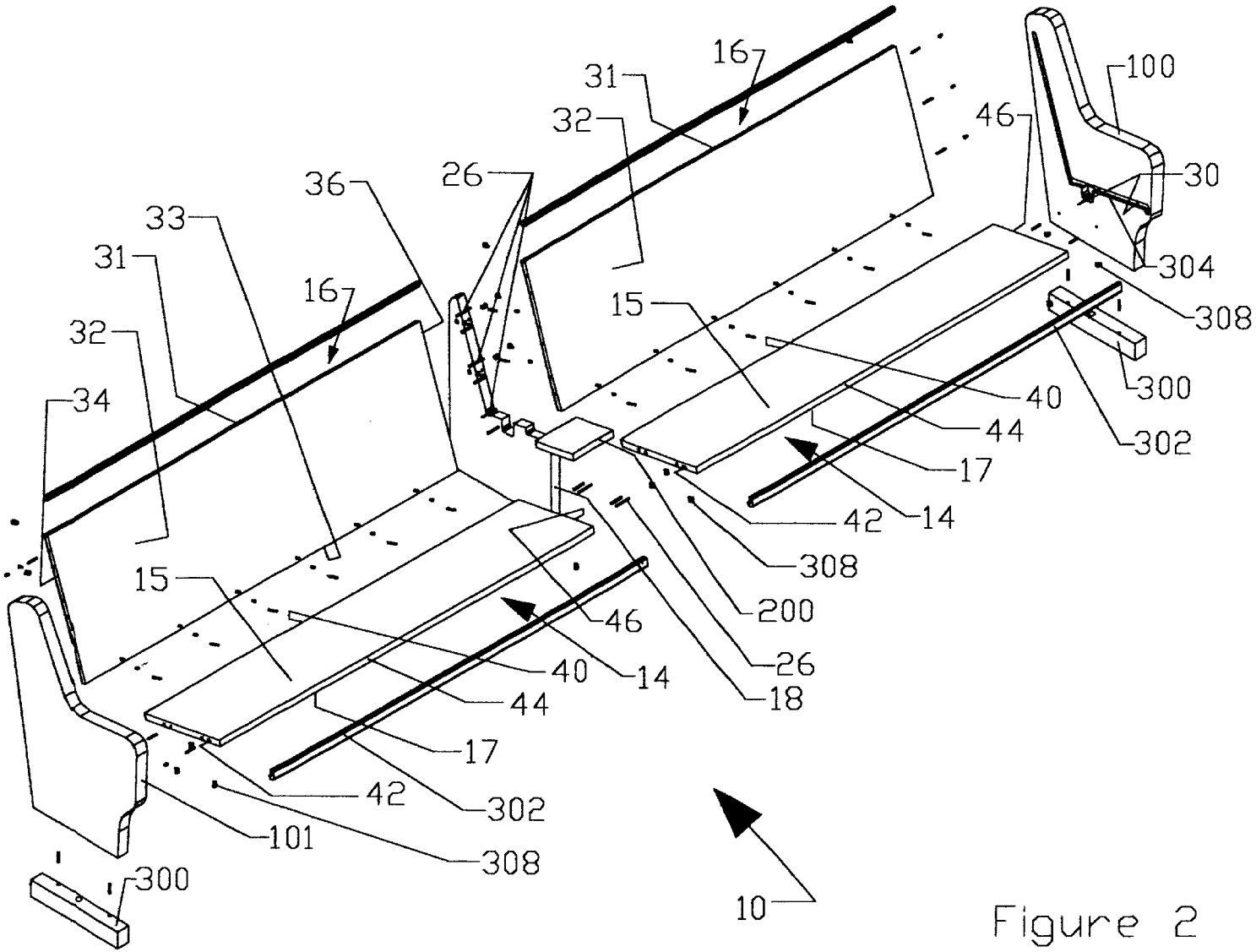
FIG. 2 is an exploded front view of the pew.

As shown in FIG. 2, the pew 10 also includes a fourth camming means 30. The pew further includes a seat portion 14 having a seat top 15, a seat bottom 17, a first seat side 40, a second seat side 42, a third seat side 44, and a fourth seat side 46.

The first camming means 24 of the pew is pivotally attached to the first seat side 40. The second camming means 26 of the pew is pivotally attached to said second seat side 42. The third camming means 28 of the pew is pivotally attached to the seat bottom 17. The fourth camming means 30 of the pew is pivotally attached to the third seat side 44.

The portable pew a back portion 16 having a front 32, and a back 31, a first back side 33, a second back side 34, a third back side 36 and a fourth back side 38. The first camming means 24 is pivotally attached to said first back side 33.

Seat 14 may be a standard pew seat without any additional covering or contouring. It is considered to be within the scope of the invention to have a pew with a suitable seat contour or possibly a cushion placed on the seat.

Legs 48, preferably have an inclined surface with surfaces extending upwards, rearward and alongside the first seat side 40.

In the preferred embodiment, legs 48 are essentially rigid, solid structures providing support to the seat 14. However, it is possible that legs 48 could be constructed from a multipart system, such as a frame, having a open center portion, and this would be within the scope of the present invention.

Legs 48 can be connected using pivotally engaging camming means which are attached by convention attaching means. In this example, nut and bolt members 19 and 21 are shown to hold the legs 48 to the seat 14. Bolt members 21 are preferably Hafele Catalog No. 262.28.946 size 34 mm bolts with galvanized steel and M6 threads. Doubled ended bolts can be used in the present invention and preferably are of the center ridge type, Hafele Catalog No. 262.28.786 being 34 mm in size and made of galvanized steel. Capped bolts usable within the scope of the present invention will depend upon the thicknesses of the legs, it is contemplated that 19 mm bolts be used preferably Hafele Catalog No. 262.27.163 parts of the 24 mm size made of bronzed steel. A spreading dowel, preferably Hafele Catalog No. 039.00.061 of the 12 mm size made of unfinished brass is used within the scope of the present invention as part of the attaching means, such as for fastening the portable pew top portion to the base. The camming means 24, 26, 28, or 30 may be of a standard camming type such as model Minifix 15 available from Hafele Catalog No. 262.25.829. All camming means 24, 26, 28 or 30 may be attached to the portable pew using bolt and nut members.

When the portable pew is in normal use position, with seat 14 connected, camming means 24 provides a positive interlock, which is ratcheted.

When the pew is to be moved, the camming means 24 can be disengaged permitting the seat 14 to lie flat.

End caps 100 and 101 shown in FIG. 2 can be attached to the back portion by a camming means 30 and 103. Although two end caps are shown, one end cap can be used within the scope of the present invention so that additional seats and be joined together at one end. FIG. 2 shows such an arrangement, wherein seat 14 is connected with seat 300, forming a two seat construction without an intervening end cap for extended seating. It is contemplated that a multiple seat pews for very large congregations can be created as easily as a one seat pews for small halls with the present invention.

The portable pew 10 may optionally be fastened to the floor for additional security, such as with nuts and bolts (not shown) but such fastening is not required. The advantage of the portable pew 10, is that it is stable under its own weight and becomes even more stable when it is sat upon.

Additionally, this portable pew 10 can be quickly and easily moved. Optionally, the pew may have wheels (not shown) attached to the bottom for easy of movement. These wheels may be spring loaded, so that when users sit upon the pew, the wheels engage into the legs so that movement of the pew is limited. It is also contemplated that the wheels may also have locking means.

It should also be noted that when a portable pew 10 is to be carried, it can be flattened and then stacked in a position so that the folded up seat 14 of one pew fits into the recess of the back of the pew on top of it. This interlocked stacking feature uniquely reduces the storage space required for portable pews to an absolute minimum and maximizes the available floor space after the pews 10 are stored away, or minimizes the space needed for storage and provides for added safety when more than one pew is stacked on top of another pew.

Dimensionally the portable pew has a seat width for normal seating, of between 8 and 16 inches wide. The back portion can be between 6 inches to 24 inches high, as a back rest. The seat can be anywhere from 14 inches to 24 inches from the floor. Normal variations in seating dimensions are considered within the scope of the present invention.

Optionally, dividers 200 with attached pew support bar 18 shown in FIG. 2 can be used between the seats for added comfort. Arm rests can be disposed on the top of the dividers.

Also additionally accessories can be attached to the back of the back portion, such as cups holders, pencil holders, head sets or kneelers.

Additionally, in another embodiment of the portable pew, it is contemplated that electricity or audio wiring can be added to the device, to enable seated users to use headphones or plug in electronic devices while sitting on the portable pew.

In one embodiment of the present invention, the pew 10 includes a first end cap 100 and a second end cap 101, which can be of different architectural styles such as gothic, baroque, romantic or shaker.

Figure 3:
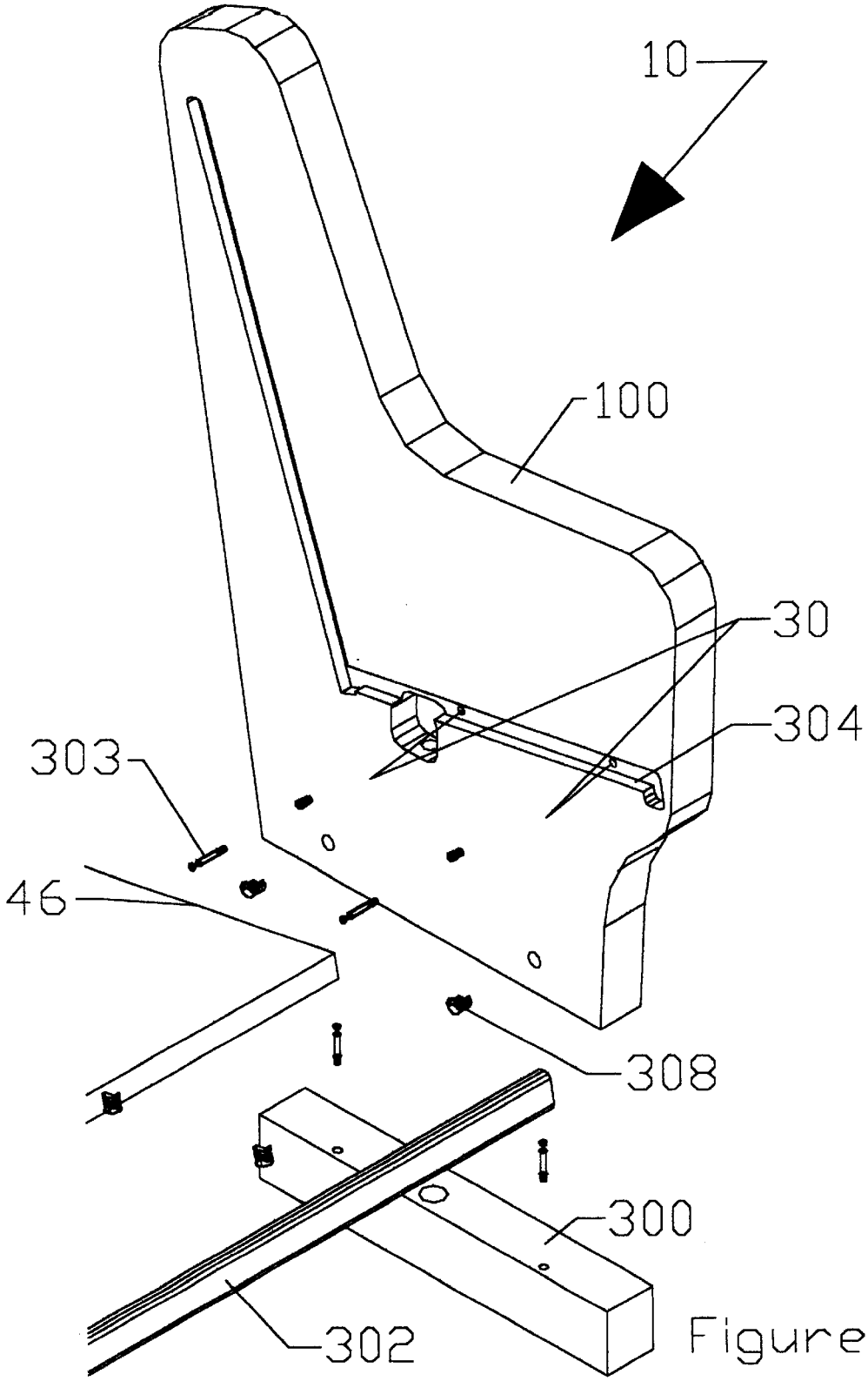
FIG. 3 is an end view of a pew in an exploded view.

FIG. 3 shows and end cap 100 acting as a support structure with cam 30.

End cap 100 is attached to side 46.

Side 46 can be supported by an optional base 300 having a supporting brace 302 to add stability to the pew. Side 46 slidably fits into grooves 304 and is secured with nuts 303and bolts 308.

Also it should be noted in FIG. 1, more than one cam can be attached to back portion 16, as shown with additional camming means 310.

While this invention has been described in connection with a single embodiment thereof, it will be understood that this embodiment is capable of modification and that this application is intended to cover any variations, uses or adaptations following, in general, the principles of the invention and including such departures from the present disclosure as come within the known or customary practice in the art to which the invention pertains, and as fall within the scope of the invention or the limits of the appended claims.

What is claimed is:

1. A portable pew adapted to be laid horizontally and stacked said pew comprising:

a first camming means, a second camming means; a third camming means and a fourth camming means attached to said pew;

said pew having at least one seat, said seat having a seat bottom, a seat top, a first seat side, a second seat side, a third seat side, and a fourth seat side, and wherein said first camming means is pivotally attached to said first seat side and said second camming means is pivotally attached to said second seat side; and said third camming means is pivotally attached to said seat bottom, and said fourth camming means is pivotally attached to said third seat side;

at least one back portion having a back portion front, and a back portion back, a first back side, a second back side, a third back side and a fourth back side, and wherein said first camming means is additionally pivotally attached to said first back side;

at least one end cap portion for supporting the portable pew in the position for use which is secured to said seat bottom with said third camming means.

2. The portable pew of claim 1, wherein said at least one end cap is attached to said second seat side and said second back side.

3. The portable pew of claim 1, wherein the material from which said seat and said back portion are constructed are selected from a member of the group consisting of: wood, plastic, laminate, metal, composites, or combinations thereof.

4. The portable pew of claim 1, further comprising a member of the group comprising: a folding kneeler, a hymnal holder, a headset holder and a communion cup holder.

* * * * *